United States Patent [19]

Honda

[11] Patent Number: 4,475,489

[45] Date of Patent: Oct. 9, 1984

[54] VARIABLE VALVE TIMING DEVICE FOR AN INTERNAL COMBUSTION ENGINE

[75] Inventor: Shoichi Honda, Tokyo, Japan

[73] Assignee: Honda Giken Kogyo Kabushiki Kaisha, Tokyo, Japan

[21] Appl. No.: 380,373

[22] Filed: May 20, 1982

[30] Foreign Application Priority Data

May 27, 1981 [JP] Japan ..... 56-79143
May 27, 1981 [JP] Japan ..... 56-79144
May 27, 1981 [JP] Japan ..... 56-79145

[51] Int. Cl.[3] ..... F01L 1/34
[52] U.S. Cl. ..... 123/90.16; 123/90.39
[58] Field of Search ..... 123/90.2, 90.15, 90.16, 123/90.17, 90.27, 90.39, 90.44

[56] References Cited

U.S. PATENT DOCUMENTS 2,410,411 11/1946 Gregory ..... 123/90.16
3,413,965 12/1968 Gavasso ..... 123/90.16

*Primary Examiner*—Michael Koczo
*Assistant Examiner*—Peggy A. Neils
*Attorney, Agent, or Firm*—Sughrue, Mion, Zinn, Macpeak & Seas

[57] ABSTRACT

In a variable valve timing device for an engine in which a pair of rocker arms driven by cams are provided for a valve in the intake or exhaust system, and fulcrums at the bases of the rocker arms are alternately displaced to cause the rocker arms to assume an operative position and an inoperative position, the two rocker arms are caused to assume their operative positions simultaneously for an overlap period before alternately assuming the operative and inoperative positions. In this manner, the high speed condition and the low speed condition are smoothly switched from one to the other.

10 Claims, 9 Drawing Figures

VARIABLE VALVE TIMING DEVICE FOR AN INTERNAL COMBUSTION ENGINE

BACKGROUND OF THE INVENTION

This invention relates to variable valve timing devices for automobile vehicle engines.

A variable valve timing device is known in the art in which a first rocker arm driven by a first cam for low speed and a second rocker arm driven by a second cam for high speed are provided for a valve in the intake or exhaust system of an engine, and fulcrums at the bases of the rocker arms are alternately displaced so that the rocker arms alternately assume an operative position in which the rocker arm is engaged with the respective cam and an inoperative position in which the rocker arm is not engaged with the respective cam (cf. Japanese Utility Model Application Publication No. 152308/1980). In this device, the fulcrums are, in general, displaced simultaneously in switching the operating positions of the arms. Accordingly, during the course of switching the operating positions, the arms are caused to take intermediate positions and engage the cams thereat, as a result of which an undesirable impact takes place. In other words, the high speed condition cannot be smoothly switched over to the low speed condition, and vice versa.

SUMMARY OF THE INVENTION

Accordingly, an object of this invention is to provide a variable valve timing device in which the abovedescribed difficulties accompanying the conventional variable valve timing device have been eliminated.

The foregoing object and other objects of this invention have been achieved by the provision of a variable valve timing device for an engine, in which a first rocker arm driven by a first cam and a second rocker arm driven by a second cam are provided for a valve in an intake or exhaust system of the engine and fulcrum means at the base of the rocker arms are alternately displaced so as to cause the rocker arms to alternately assume an operative position in which the rocker arm engages the respective cam and inoperative position in which the arm does not engage with the respective cam, which, according to the invention, includes means for causing the two rocker arms to take the respective operative positions simultaneously once in allowing the rocker arms to alternately take the operative position and the inoperative position.

The nature, principle and utility of the invention will become more apparent from the following detailed description when read in conjunction with the accompanying drawings, in which like parts are designated by like reference numerals or characters.

DETAILED DESCRIPTION OF THE PREFERRED EMBODIMENTS

Figure 1:
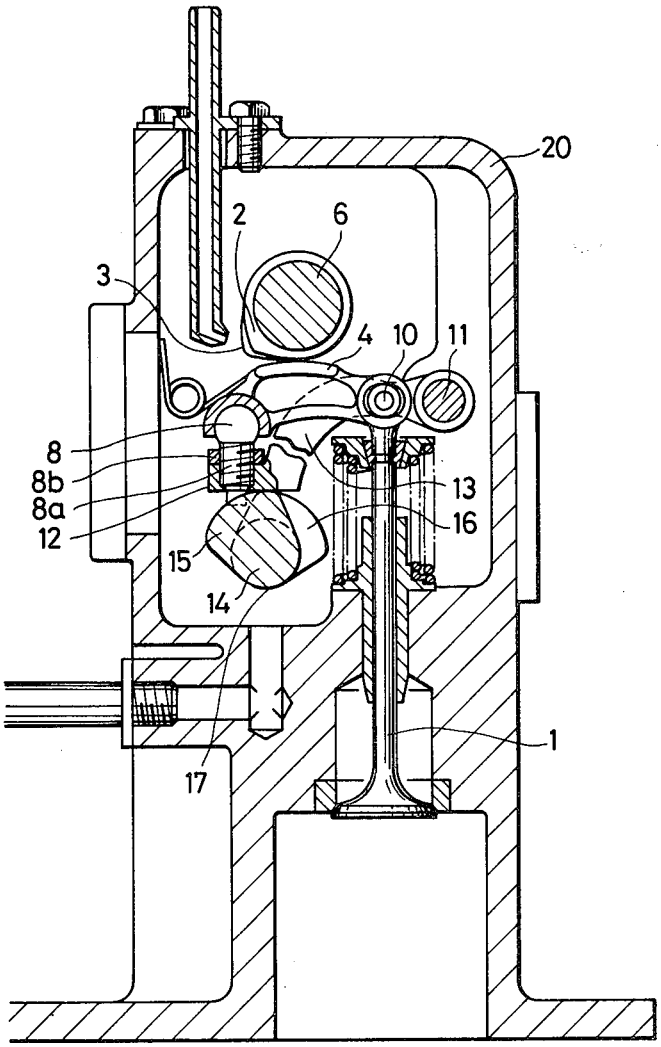
FIG. 1 is a front view, with parts cut away, showing one example of a variable valve timing device according to this invention.
Figure 2:
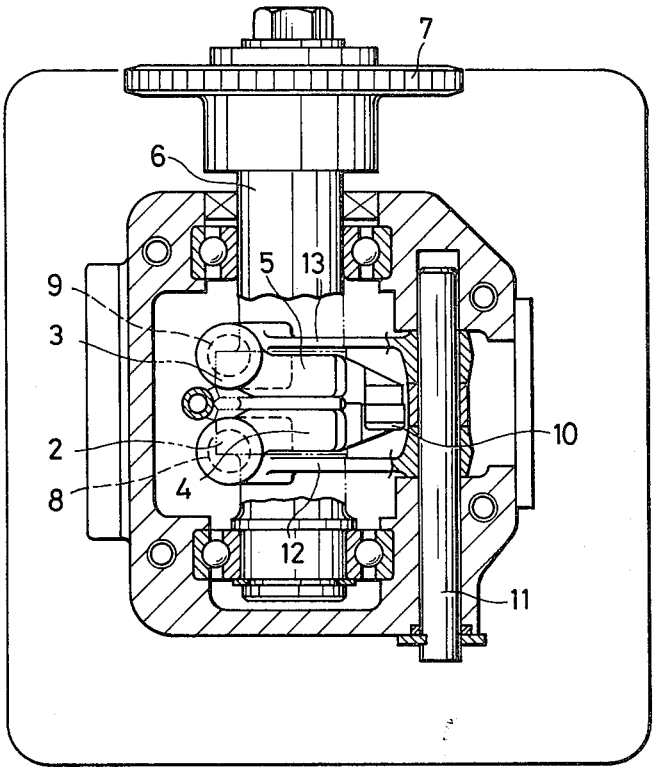
FIG. 2 is a plan view, with parts cut away, showing the device of FIG. 1.
Figure 3:
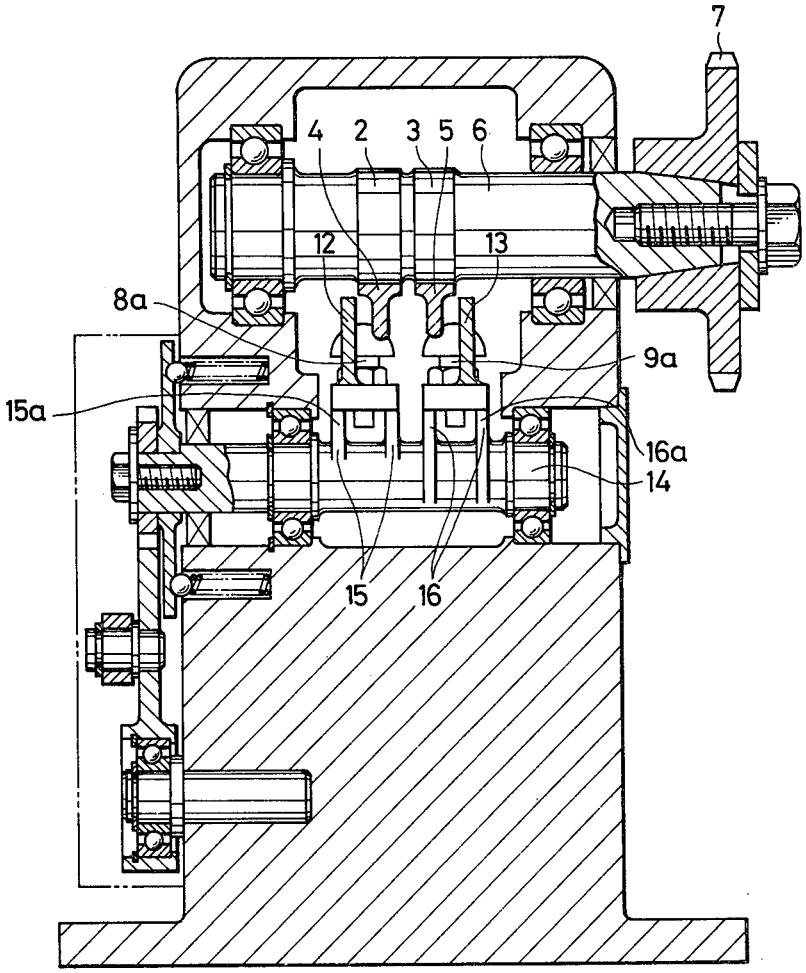
FIG. 3 is a side view, with parts cut away, showing the device of FIG. 1.

One example of a variable valve timing device according to this invention, as shown in FIGS. 1, 2 and 3, includes a pair of rocker arms, namely, a first rocker arm 4 and a second rocker arm 5 provided above a valve 1 in an intake or exhaust system. The first and second rocker arms 4 and 5 are driven by a first cam 2 for low speed and a second cam 3 for high speed, respectively. The cams 2 and 3 are juxtaposed on one cam shaft 6 having a cam sprocket 7 at one end through which the cam shaft 6 is coupled to the crank shaft of an engine, so that the cam shaft 6 is rotated in synchronization with the crank shaft.

The rocker arms 4 and 5 are of the type where fulcrums 8 and 9 at the bases of the rocker arms 4 and 5 are alternately displaced so that the rocker arms alternately assume an operative position in which the rocker arm is engaged with the respective cam and an inoperative position in which the rocker arm is not engaged with the respective cam. More specifically, a low speed condition in which the first rocker arm 4 is selected to be operative, and a high speed condition in which the second rocker arm 5 is selected to be operative are alternately obtained. In the low speed condition, the fulcrum 8 is moved upwardly so that the first rocker arm 4 is engaged with the first cam 2, while the fulcrum 9 is moved downwardly so that the second rocker arm 9 is not engaged with the second cam 3. In the high speed condition, the fulcrum 8 is moved downwardly so that the first rocker arm 4 is not engaged with the first cam 2, while the fulcrum 9 is moved upwardly so that the second rocker arm 5 is engaged with the second cam 3.

The end portions of the front end sides of the arms 4 and 5 are set adjacent to each other and are rotatably coupled to a pin 10 extending laterally. On the other hand, the fulcrum sides of the arms are set apart from each other, and their lower surfaces are supported by supporting arms 12 and 13 extended from a supporting shaft 11 which is disposed beside the arms. The fulcrums 8 and 9 are composed of spherical pivots adapted to support the bases of the arms from below. Threaded rods 8*a* and 9*a* extend from the spherical pivots, so as to threadably engage the arms 12 and 13. In this case, it is desirable that, when the rocker arms 4 and 5 are set in the operative positions, the gaps between the arms 4 and 5 and the cams 2 and 3, namely, the cam gaps, can be adjusted as desired. For this purpose, nuts 8*b* and 9*b* are combined with the threaded rods 8*a* and 9*a*, so that the heights of the fulcrums 8 and 9 can be adjusted as desired, respectively.

Figure 6:
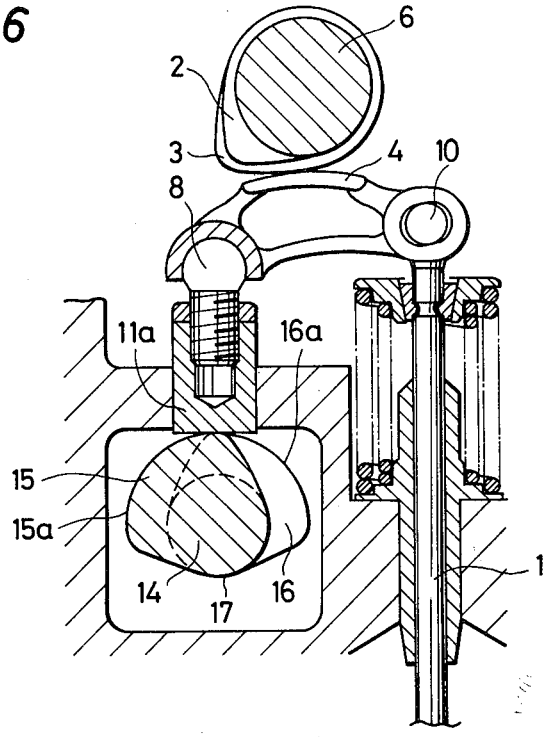
FIGS. 6 and 7 are a sectional front view and a sectional side view, respectively, showing one modification of the device according to the invention.
Figure 7:
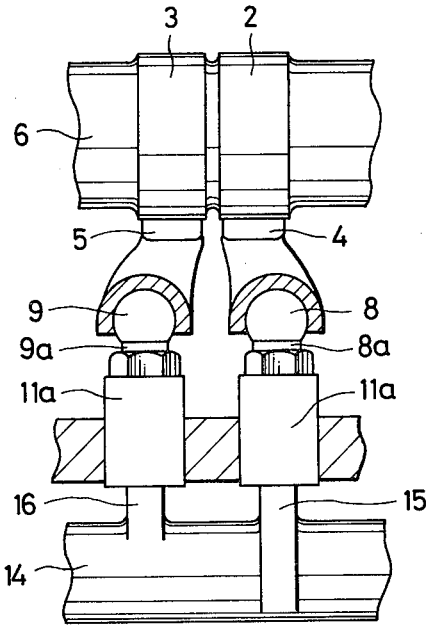

As is apparent from FIGS. 1 through 3, the abovedescribed supporting arms 12 and 13 are rockable, being supported by the lateral supporting shaft 11 which is secured to the engine body 20. The device thus constructed may be modified as shown in FIGS. 6 and 7. In this modification, the supporting arms 12 and 13 are not supported by a supporting shaft 11. More specifically, the arms are provided unitarily with the engine body, for example, and are engaged with supporting posts 11*a* so that the latter are vertically rockably supported thereby.

Figure 8:
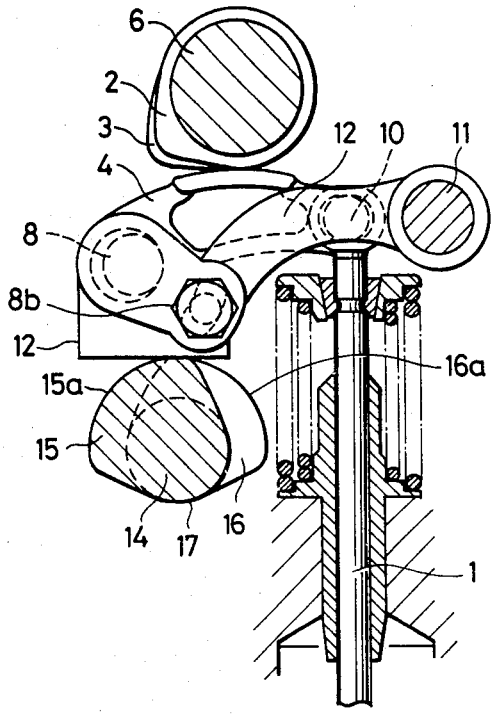
FIGS. 8 and 9 are a front view and a top view, with parts cut away, showing another modification of the device according to the invention.
Figure 9:
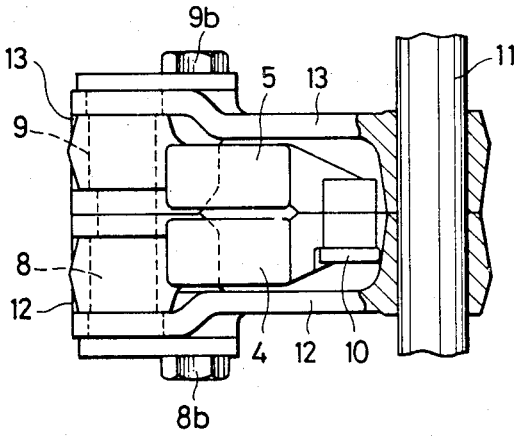

Another modification of the variable valve timing device of the invention is as shown in FIGS. 8 and 9. In this modification, the fulcrums 8 and 9 are composed of eccentric pins which are laterally inserted into the bases of the rocker arms 4 and 5. The eccentric pins are pivotally supported by the arms 12 and 13, respectively, and are fixedly secured at their suitable eccentric positions with screws 8*b* and 9*b*. According to the amount of eccentricity, the heights of the fulcrums 8 and 9 are adjusted, so that the cam gaps are set to suitable values, respectively.

Figure 4:
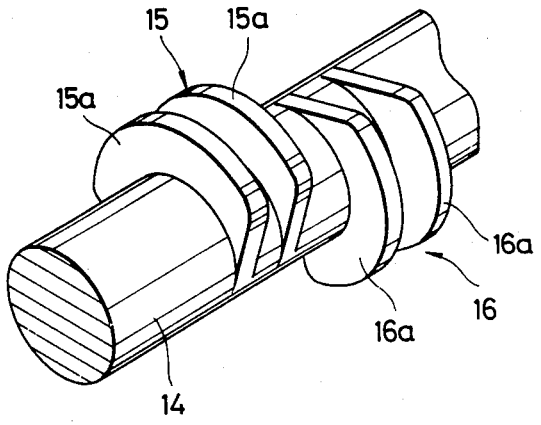
FIG. 4 is a perspective view of the control cams of the device according to the invention.

The aforementioned high and low speed conditions are switched by control cams provided below the fulcrums 8 and 9. More specifically, a cam shaft 14 is provided below the fulcrums 8 and 9 as shown in FIGS. 1 or 3. The cam shaft 14 has a first control cam 15 for supporting the fulcrum 8 of the first rocker arm 4 and a second control cam 16 for supporting the fulcrum 9 of the second rocker arm 5, as shown in FIG. 4.

The control cams 15 and 16 have cam surfaces 15*a* and 16*a* for moving the fulcrums 8 and 9 up and down. The cam surfaces 15*a* and 16*a* are different in phase from each other; however, it should be noted that the cam surfaces 15*a* and 16*a* overlap each other at the ends as shown in FIG. 4, so that, when the cam surface 15*a* terminates, the cam surfaces 16*a* has started. On the side of the cam shaft 14 which is opposite to the side where the cam surfaces are provided, a base circle surface 17 is formed.

Figure 5:
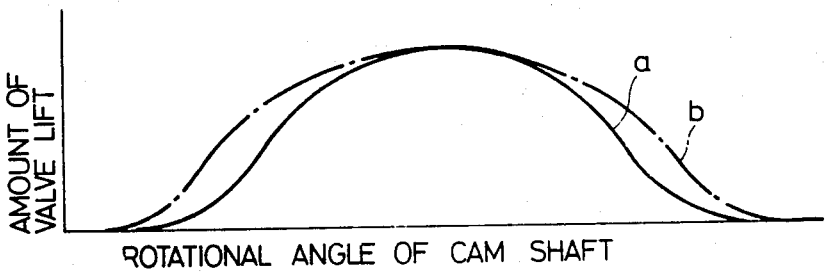
FIG. 5 is a graphic representation indicating the valve lift curves, for describing the operation of the control cams of FIG. 4.

The operation of the variable valve timing device according to the invention will now be described. Let us consider the case when the cam shaft 14 is turned counterclockwise. In this case, first the first control cam 15 becomes operative, so that the fulcrum 8 is moved upwardly to allow the first rocker arm 4 to assume the operative position, and accordingly the valve 1 is operated by the first cam 2 engaged with the first rocker arm 4. That is, the valve 1 is placed in the low speed condition. In this operation, the valve lift curve is as indicated by the line a in FIG. 5.

As the cam shaft 14 is further turned, the second control cam 16 becomes operative, so that the fulcrum 9 is moved upwardly to allow the second rocker arm 5 to assume the operative position, and therefore the valve 1 is operated by the second cam 3 engaged with the second rocker arm 5. That is, the valve 1 is placed in the high speed condition. The valve lift curve in this operation is as indicated by the line b in FIG. 5.

Let us consider the operation of changing the low speed condition over to the high speed condition. As was described above, the two control cams 15 and 16 "overlap" each other at the ends thereof. Accordingly, before the position of the first rocker arm 4 is changed from the operative position over to the inoperative position, the position of the second rocker arm 5 is changed from the inoperative position over to the operative position. In other words, after both arms 4 and 5 assume operative positions, the positions thereof are changed. Accordingly, the device of the invention is free from the above-described difficulty caused when the two arms 4 and 5 impact with the cams at intermediate positions.

As the cam shaft 14 is further turned, the base circle surface 17 faces the fulcrums, so that both fulcrums 8 and 9 are moved downwardly. Accordingly, the two rocker arms 4 and 5 assume inoperative positions, and the valve 1 is maintained closed.

As is apparent from the above description, in switching the first rocker arm and the second rocker arm, the arms are caused to simultaneously assume operative positions, which makes it possible to smoothly switch the operating positions of the arms.

As the adjusting member is provided at the end portion of the base side of each rocker arm, the fulcrum position of each arm can be individually adjusted at the end portion of the base side thereof, to adjust the cam gap as desired. Thus, the variable valve timing device of the invention, unlike the conventional device in which the two arms were adjusted with one adjusting screw, can achieve adjustment readily and positively.

What is claimed is:

1. A variable valve timing device for an engine comprising; a first rocker arm driven by a first rocker cam, a second rocker arm driven by a second rocker cam provided for a valve in at least one of an intake and an exhaust system of said engine, said first and second rocker cams driven in synchronization with the revolution of the engine, fulcrum means at the bases of said rocker arms alternately displaced to cause said rocker arms to alternately take an operative position in which the rocker arm is engaged with the respective rocker cam and an inoperative position in which the rocker arm is not engaged with the respective rocker cam, and, means for causing said two rocker arms to assume said respective operative positions simultaneously for a time period prior to either of said rocker arms being displaced to assume its operative position.

2. A device as claimed in claim 1, wherein said fulcrum means at the bases of said rocker arms are supported by first and second control cams which are formed on a common cam shaft, in such a manner that said fulcrum means are displaced as said cam shaft is rotated.

3. A device as claimed in claim 2, further comprising, a pair of supporting arms having said fulcrum means at end portions thereof, said supporting arms being arranged on both sides of said rocker arms in such a manner that said fulcrum means are engaged through said supporting arms with said first and second control cams provided below said fulcrum means.

4. A device as claimed in claim 1, further comprising, a pair of supporting posts supporting said fulcrum means, said supporting posts being arranged below said rocker arms in such a manner that said fulcrum means are engaged through said supporting posts with control cams provided below said fulcrum means.

5. A device as claimed in claim 3, in which said first and second control cams have first and second cam surfaces overlapping each other at ends thereof, so that one rocker arm assumes said operative position before said other rocker arm assume said inoperative position.

6. A device as claimed in claims 1 or 2, in which front end portions of said rocker arms are rotatably coupled by a laterally extending pin in a manner such that said front end portions are adjacent each other, and said rocker arms are provided with means for adjusting the positions of said fulcrum means at the bases thereof.

7. A device as claimed in claim 1, wherein said fulcrum means include eccentric pins inserted laterally into said rocker arms, said pins being pivotably supported.

8. A device as claimed in claim 1, wherein said first rocker arm is driven by said first rocker cam for low speed operation, said second rocker arm being driven by said second rocker cam for high speed operation.

9. A device as claimed in claim 1, wherein said first and second rocker cams are supported by a single cam shaft.

10. A device as claimed in claim 1, further comprising a pin connected to said valve, said first and second rocker arms having ends opposite said bases thereof connected to said pin.

* * * * *